United States Patent [19]

Curcio

[11] 4,022,393

[45] May 10, 1977

[54] ROLLER DEVICE

[76] Inventor: Michael Curcio, 168-17 Cryders Lane, Whitestone, N.Y. 11357

[22] Filed: Jan. 12, 1976

[21] Appl. No.: 648,480

[52] U.S. Cl. ..... 242/55.2; 242/71.9; 242/74; 242/105; 242/106

[51] Int. Cl.[2] ..... B65H 19/02

[58] Field of Search ..... 242/55.2, 105, 71.9, 242/73, 74, 74.1, 74.2, 86.4, 94, 86.52, 106, 77, 78, 71.8, 77.1, 78.3, 68.4, 81, 103, 55

[56] References Cited

UNITED STATES PATENTS

| | | | |
|---|---|---|---|
| 669,342 | 3/1901 | Gally | 242/71.9 |
| 951,718 | 3/1910 | Arnsdorff | 242/86.52 |
| 1,009,829 | 11/1911 | Clark | 242/71.9 |
| 2,710,727 | 6/1955 | Crowick | 242/71.9 X |
| 3,447,759 | 6/1969 | Rau | 242/71.9 |

*Primary Examiner*—George F. Mautz
*Attorney, Agent, or Firm*—Daniel Jay Tick

[57] ABSTRACT

A first disc-type plate is coaxially affixed to the first end of a shaft and rotatable with the shaft. A second disc-type plate is coaxially mounted on the shaft. A fastener releasably affixes the second plate to the shaft at any desired point thereon between the first plate and the second end of the shaft for rotation with the shaft. A retainer on one of the plates retains an end of a strip of flexible material in position at the one of the plates and at the shaft whereby the strip is selectively windable on and unwindable from the roller device.

6 Claims, 8 Drawing Figures

FIG. 1
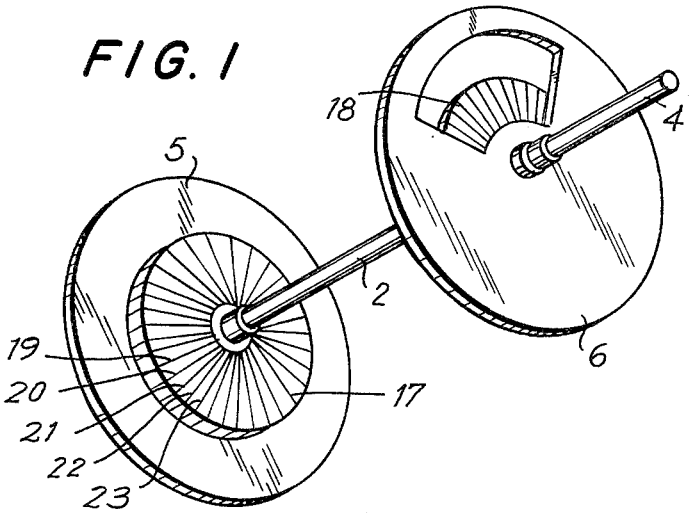
FIG. 2
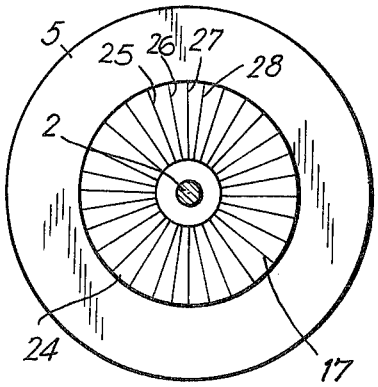
FIG. 3
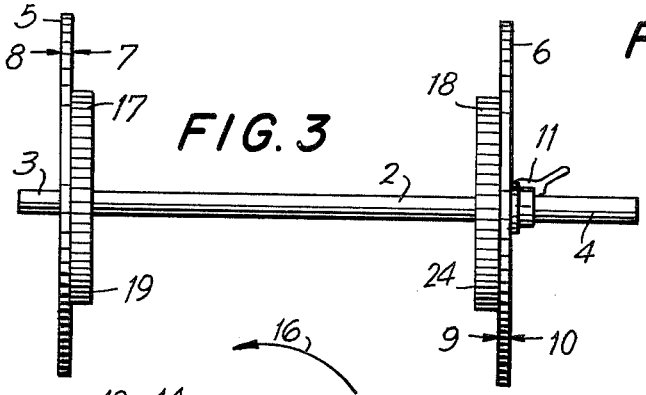
FIG. 4
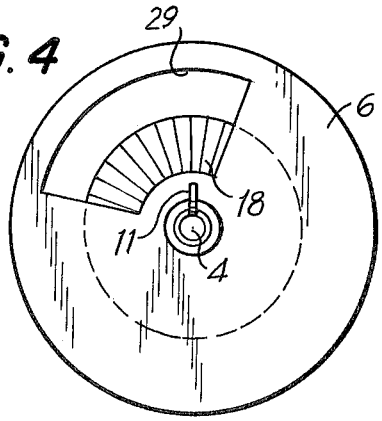
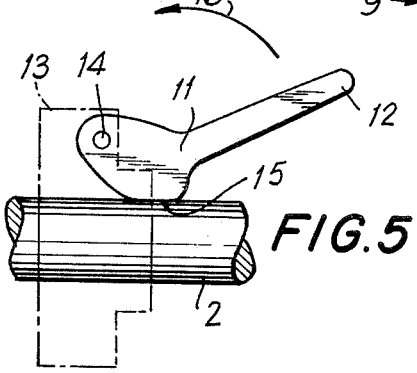
FIG. 5
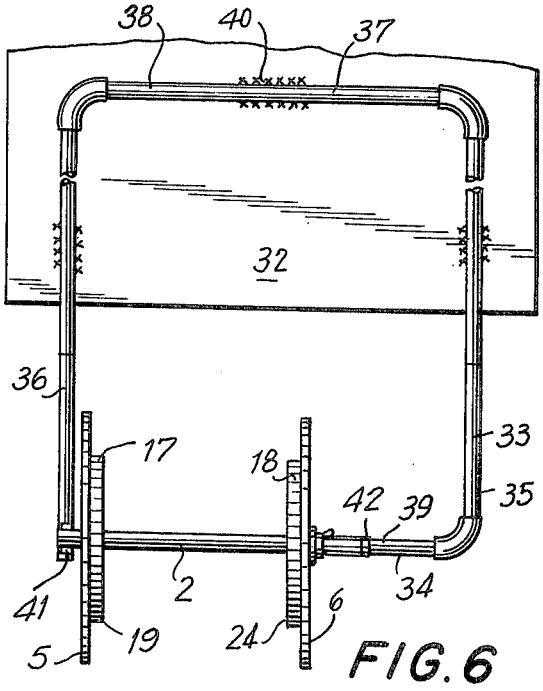
FIG. 6
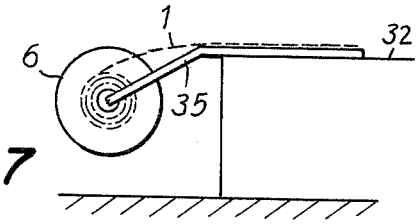
FIG. 7
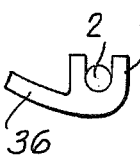
FIG. 8

ROLLER DEVICE

BACKGROUND OF THE INVENTION

The present invention relates to a roller device. More particularly, the invention relates to a roller device for a strip of flexible material.

Aluminum stripping of different widths is used in siding structures. The aluminum stripping is awkward, bulky and difficult to handle and is even more difficult to transport without damage, due to its great length and minute thickness.

The principal object of the invention is to provide a roller device for transporting, storing and handling a strip of flexible material such as flexible metal, such as, for example, aluminum.

An object of the invention is to provide a roller device of simple structure, which is inexpensive in manufacture, for transporting, storing and handling flexible material of any width.

Another object of the invention is to provide a roller device of simple, but sturdy, structure for transporting, storing and handling flexible material of any width with facility, convenience and rapidity.

Still another object of the invention is to provide a roller device for transporting, storing and handling aluminum stripping of any desired length and width with facility, convenience, rapidity and without damage.

Yet another object of the invention is to provide a roller device which functions efficiently, effectively and reliably to transport, store and provide as desired aluminum stripping with facility, convenience, safety and freedom from damage.

BRIEF SUMMARY OF THE INVENTION

In accordance with the invention, a roller device for a strip of flexible material comprises a shaft having spaced opposite first and second ends. A first disc-type plate is coaxially affixed to the first end of the shaft and rotatable with the shaft. A second disc-type plate is coaxially mounted on the shaft. Fastening means releasably affixes the second plate to the shaft at any desired point thereon between the first plate and the second end of the shaft for rotation with the shaft. Retaining means on at least one of the first and second plates retains an end of a strip of flexible material in position at the one of the plates and at the shaft whereby the strip is selectively windable on and unwindable from the roller device.

Each of the first and second plates has a first substantially planar surface facing that of the other and a second substantially planar surface spaced from the first surface and facing away from that of the other. The retaining means comprises a substantially disc-type ancillary plate coaxially affixed to the first surface of the one of the plates and having a plurality of substantially radially extending slits formed therein, each dimensioned to accommodate an end of said strip of flexible material.

Each of the first and second plates has a first substantially planar surface facing that of the other and a second substantially planar surface spaced from the first surface and facing away from that of the other. The retaining means comprises a substantially disc-type first ancillary plate coaxially affixed to the first surface of the first plate and a substantially disc-type second ancillary plate coaxially affixed to the first surface of the second plate. Each of the ancillary plates has a plurality of substantially radially extending slits formed therein each dimensioned to accommodate an end of the strip of flexible material.

The fastening means comprises a lever device pivotally affixed to the second plate in operative proximity with the shaft and having a contact surface consisting of material having a high coefficient of friction selectively movable into contact with the shaft to releasably secure the second plate to the shaft.

A support device is releasably coupleable to the roller device for rotatably mounting the roller device in operative proximity with a work surface. The support device comprises frame means having spaced opposite first and second end areas. Mounting means affixes the frame means in the first end area thereof to a work surface. Bearing means mounted in the frame means in the second end area thereof rotatably mounts the first and second ends of the shaft.

BRIEF DESCRIPTION OF THE DRAWINGS

In order that the invention may be readily carried into effect, it will now be described with reference to the accompanying drawings, wherein:

FIG. 1 is a perspective view of an embodiment of the roller device of the invention;

FIG. 2 is an axial view of a plate of the roller device of the invention;

FIG. 3 is a side view of the embodiment of FIG. 1;

FIG. 4 is an axial view of the other plate of the roller device of the invention;

FIG. 5 is a view, on an enlarged scale, of an embodiment of the fastening device of the roller device of the invention;

FIG. 6 is a top view of an embodiment of the support device of the roller device of the invention;

FIG. 7 is a side view of the embodiment of FIG. 6; and

FIG. 8 is a view, on an enlarged scale, of a bearing of the support device of FIGS. 6 and 7.

In the FIGS., the same components are identified by the same reference numerals.

DETAILED DESCRIPTION OF THE INVENTION

The roller device of the invention is for a strip of flexible material 1 (FIG. 7) of any suitable type, such as a flexible metal, such as, for example, aluminum. The strip of flexible material 1 is shown in broken lines in FIG. 7 to maintain the clarity of illustration.

The roller device of the invention comprises a shaft 2 (FIGS. 1, 3, 5, 6 and 8) of any suitable type, and preferably of iron or steel pipe. The shaft 2 has spaced opposite first and second ends 3 and 4 (FIG. 3), respectively.

A first disc-type plate 5 of any suitable type such as, for example, aluminum, is coaxially affixed to the first end 3 of the shaft 2 and is rotatable with said shaft (FIGS. 1, 2, 3 and 6).

A second disc-type plate 6 of any suitable type such as, for example, aluminum, is coaxially mounted on the shaft 2 (FIGS. 1, 3, 4, 6 and 7).

The first plate 5 has a first substantially planar surface 7 facing that of the second plate 6 and a second substantially planar surface 8 spaced from said first surface and facing away from that of said second plate (FIG. 3). The second plate 6 has a first substantially planar surface 9 facing that of the first plate 5 and a second substantially planar surface 10 spaced from said first surface and facing away from that of said first plate (FIG. 3).

A fastening device 11, shown in FIGS. 3 and 5, but not shown in any of the other FIGS., in order to maintain the clarity of illustration, releasably affixes the second plate 6 to the shaft 2 at any desired point thereon between the first plate 5 and the second end 4 of said shaft for rotation with said shaft.

The fastening device 11 comprises, as shown in FIG. 5, a lever device 12 pivotally affixed to the second plate 6, via a collar 13 and a pivot pin 14 in said collar, in operative proximity with the shaft 2. The lever device 12 has a contact surface 15 consisting of material having a high coefficient of friction such as, for example, rubber, ridged rubber, or the like (FIG. 5). The contact surface 15 is selectively movable into contact with the shaft 2 to releasably secure the second plate 6 to said shaft, as shown in FIG. 5.

When the lever device 12 is rotated about the pivot pin 14 in the direction of an arrow 16 in FIG. 5, the contact surface 15 is moved out of contact with the shaft 2 and the second plate 6 is freely movable along said shaft. This enables the adjustment of the distance between the plates 5 and 6 to accommodate flexible material of any width.

Retaining devices 17 and 18 are provided on the plates 5 and 6, respectively, as shown in FIGS. 3 and 6, for retaining an end of the strip of flexible material 1 (FIG. 7) in position at said plates and at the shaft 2 whereby said strip is selectively windable on and unwindable from the roller device of the invention.

The retaining device 17 comprises a substantially disc-type first ancillary plate 19 coaxially affixed to the first surface 7 of the first plate 5 (FIGS. 1, 3 and 6). The ancillary plate 19 has a plurality of substantially radially extending slits 20, 21, 22, 23, and so on, formed therein (FIG. 1). Each of the slits is dimensioned to accommodate an end of the strip of flexible material 1.

The retaining device 18 comprises a substantially disc-type second ancillary plate 24 coaxially affixed to the first surface 9 of the second plate 6 (FIGS. 2, 3 and 6). The ancillary plate 24 has a plurality of substantially radially extending slits 25, 26, 27, 28, and so on, formed therein (FIG. 2). Each of the slits is dimensioned to accommodate an end of the strip of flexible material 1.

Parts of either or both plates 5 and 6 may be cut out to reduce weight and/or save metal. Thus, as shown in FIG. 4, the second plate 6 may have a substantially sectoral cutout 29. The cutout 29 permits the placing of an end of the strip of material 1 in the retaining device 18 after the plate 6 is moved into position in accordance with the width of said strip.

A support device, shown in FIGS. 6, 7 and 8, is releasably coupleable to the roller device for rotatably mounting said roller device in operative proximity with a work surface 32 (FIGS. 6 and 7). The support device comprises a frame 33 consisting of pipes or bars 34, 35, 36 and 37, preferably of steel, coupled to each other by suitable coupling joints (FIG. 6). The frame 33 has spaced opposite first and second end areas 38 and 39, respectively (FIG. 6). The frame 33 may comprise a single, unitary member.

A mounting device 40 of any suitable type such as, for example, clamps, stays, welds, bolts, rivets, or the like, affixes the frame 33 in the first end area 38 thereof to the work surface 32, as shown in FIG. 6. Bearings 41 (FIGS. 6 and 8) and 42 (FIG. 6) are mounted in the frame 33 in the second end area 39 thereof and rotatably mount the first and second ends 3 and 4 of the shaft 2. The bearing 41, as shown in FIG. 8 is of U-shape to facilitate removal and insertion of shafts.

While the invention has been described by means of a specific example and in a specific embodiment, I do not wish to be limited thereto, for obvious modifications will occur to those skilled in the art without departing from the spirit and scope of the invention.

I claim:

1. A roller device for a strip of flexible material, said roller device comprising a shaft having spaced opposite first and second ends;

a first disc-type plate coaxially affixed to the first end of the shaft and rotatable with said shaft;

a second disc-type plate coaxially mounted on the shaft;

fastening means for releasably affixing the second plate to the shaft at any desired point thereon between the first plate and the second end of the shaft for rotation with said shaft;

retaining means on at least one of the first and second plates for retaining an end of a strip of flexible material in position at said one of said plates and at said shaft whereby said strip is selectively windable on and unwindable from said roller device; and a support device releasably coupleable to said roller device for rotatably mounting said roller device in operative proximity with a work surface, said support device comprising frame means having spaced opposite first and second end areas, mounting means affixing the frame means in the first end area thereof to a work surface, and bearing means mounted in the frame means in the second end area thereof rotatably mounting the first and second ends of the shaft.

2. A roller device as claimed in claim 1, wherein the fastening means comprises a lever device pivotally affixed to the second plate in operative proximity with the shaft and having a contact surface consisting of material having a high coefficient of friction selectively movable into contact with the shaft to releasably secure said second plate to said shaft.

3. A roller device for a strip of flexible material, said roller device comprising a shaft having spaced opposite first and second ends;

a first disc-type plate coaxially affixed to the first end of the shaft and rotatable with said shaft;

a second disc-type plate coaxially mounted on the shaft, each of the first and second plates having a first substantially planar surface facing that of the other and a second substantially planar surface spaced from the first surface and facing away from that of the other;

fastening means for releasably affixing the second plate to the shaft at any desired point thereon between the first plate and the second end of the shaft for rotation with said shaft; and retaining means on at least one of the first and second plates for retaining an end of a strip of flexible material in position at said one of said plates and at said shaft whereby said strip is selectively windable on and unwindable from said roller device, said retaining means comprising a substantially disc-type ancillary plate coaxially affixed to the first surface of said one of said plates and having a plurality of substantially radially extending slits formed therein each dimensioned to accommodate an end of said strip of flexible material.

4. A roller device as claimed in claim 3, wherein the fastening means comprises a lever device pivotally affixed to the second plate in operative proximity with the shaft and having a contact surface consisting of material having a high coefficient of friction selectively movable into contact with the shaft to releasably secure said second plate to said shaft.

5. A roller device for a strip of flexible material, said roller device comprising a shaft having spaced opposite first and second ends;

a first disc-type plate coaxially affixed to the first end of the shaft and rotatable with said shaft;

a second disc-type plate coaxially mounted on the shaft, each of the first and second plates having a first substantially planar surface facing that of the other and a second substantially planar surface spaced from the first surface and facing away from that of the other;

fastening means for releasably affixing the second plate to the shaft at any desired point thereon between the first plate and the second end of the shaft for rotation with said shaft; and retaining means on at least one of the first and second plates for retaining an end of a strip of flexible material in position at said one of said plates and at said shaft whereby said strip is selectively windable on and unwindable from said roller device, said retaining means comprising a substantially disc-type first ancillary plate coaxially affixed to the first surface of the first plate and a substantially disc-type second ancillary plate coaxially affixed to the first surface of the second plate, each of said ancillary plates having a plurality of substantially radially extending slits formed therein each dimensioned to accommodate an end of the strip of flexible material.

6. A roller device as claimed in claim 5, wherein the fastening means comprises a lever device pivotally affixed to the second plate in operative proximity with the shaft and having a contact surface consisting of material having a high coefficient of friction selectively movable into contact with the shaft to releasably secure said second plate to said shaft.

* * * * *